US007559295B2

(12) United States Patent
Yamada et al.

(10) Patent No.: US 7,559,295 B2
(45) Date of Patent: Jul. 14, 2009

(54) COOLING STRUCTURE FOR A WORK VEHICLE

(75) Inventors: Masahiro Yamada, Sakai (JP); Yoshikazu Togoshi, Osaka (JP); Akira Minoura, Osaka (JP); Yoshihiro Ueda, Sakai (JP); Yoshiyuki Esaki, Sakai (JP); Eiji Satou, Sakai (JP); Takeshi Komorida, Sakai (JP)

(73) Assignee: Kubota Corporation, Osaka (JP)

( * ) Notice: Subject to any disclaimer, the term of this patent is extended or adjusted under 35 U.S.C. 154(b) by 121 days.

(21) Appl. No.: 11/853,519

(22) Filed: Sep. 11, 2007

(65) Prior Publication Data

US 2009/0013942 A1 Jan. 15, 2009

(30) Foreign Application Priority Data

May 31, 2007 (JP) ..... 2007-145983

(51) Int. Cl.
*F01P 5/02* (2006.01)
*F28D 15/00* (2006.01)

(52) U.S. Cl. ..... 123/41.31; 180/68.1; 180/68.2

(58) Field of Classification Search ..... 123/41.31, 123/41.65, 41.49, 41.7, 41.48, 41.56; 180/68.1, 180/68.2, 69.24, 68.6, 69.2, 89.17
See application file for complete search history.

(56) References Cited

U.S. PATENT DOCUMENTS 3,868,992 A * 3/1975 Getz et al. ..... 165/51
4,771,844 A * 9/1988 Bassett ..... 180/68.1
5,174,406 A * 12/1992 Lee ..... 180/68.2
5,239,812 A * 8/1993 Samejima et al. ..... 56/15.6
5,367,861 A * 11/1994 Murakawa et al. ..... 56/11.8
5,816,351 A * 10/1998 Akira et al. ..... 180/68.1
6,435,264 B1 * 8/2002 Konno et al. ..... 165/41
6,530,200 B1 * 3/2003 Minoura et al. ..... 56/17.1
6,578,656 B2 * 6/2003 Samejima et al. ..... 180/291
6,655,486 B2 * 12/2003 Oshikawa et al. ..... 180/68.1
6,675,567 B2 * 1/2004 Samejima et al. ..... 56/16.7
6,848,246 B2 * 2/2005 Samejima et al. ..... 56/320.2
7,047,912 B2 * 5/2006 Mimuro et al. ..... 123/41.33
7,458,434 B2 * 12/2008 Samejima et al. ..... 180/68.1
2006/0016632 A1 * 1/2006 Samejima et al. ..... 180/68.1

FOREIGN PATENT DOCUMENTS

JP 2004237953 A * 8/2004
JP 2007009825 1/2007

* cited by examiner

*Primary Examiner*—Michael Cuff
*Assistant Examiner*—Hung Q Nguyen
(74) *Attorney, Agent, or Firm*—The Webb Law Firm

(57) ABSTRACT

A cooling structure for a working vehicle with a transmission disposed rearwardly and downwardly of a driver's seat and having a hydrostatic transmission, and an air-cooled engine disposed rearwardly of the transmission. The cooling structure comprising a fan for cooling the engine and a fan for cooling the transmission mounted on a rotary shaft operatively connecting the transmission with an output shaft of the air-cooled engine, the fans being configured such that air flows generated by the fans move from adjacent the transmission toward the engine; an oil cooler for cooling fluid supplied to the hydrostatic transmission, the oil cooler being disposed between the fan for cooling the engine and the fan for cooling the transmission, and disposed to face each of the fans; and an air guiding plate disposed at a position higher than the oil cooler for guiding air to regions of the fans.

5 Claims, 11 Drawing Sheets

COOLING STRUCTURE FOR A WORK VEHICLE

BACKGROUND OF THE INVENTION

This invention relates to a cooling structure for a working vehicle having an oil cooler.

A known cooling structure for a working vehicle having a water-cooled engine includes a cooling fan driven by the engine for cooling a radiator. Cooling air flows generated by the cooling fan are supplied to the radiator and an oil cooler opposed to the radiator to cool oil (see JP 2007-9825, for example).

In the above construction, the working vehicle has the water-cooled engine requiring many accessories such as the radiator and a water pump. Thus, the working vehicle tends to become large and costly.

SUMMARY OF THE INVENTION

The object of this invention is to provide a cooling structure for cooling oil without increasing the size and cost of a working vehicle.

A cooling structure for a working vehicle, according to this invention, with a transmission disposed rearwardly and downwardly of a driver's seat and having a hydrostatic transmission, and an air-cooled engine disposed rearwardly of the transmission, comprises a fan for cooling the engine and a fan for cooling the transmission mounted on a rotary shaft operatively connecting the transmission with an output shaft of the air-cooled engine, the fans being configured such that air flows generated by the fans move from adjacent the transmission toward the engine; an oil cooler for cooling fluid supplied to the hydrostatic transmission, the oil cooler being disposed between the fan for cooling the engine and the fan for cooling the transmission, and disposed to face each of the fans; and an air guiding plate disposed at a position higher than the oil cooler for guiding air to regions of the fans.

With this characteristic construction, instead of installing a water-cooled engine which requires many accessories such as a radiator and a water pump, oil stored in the change speed devices and oil passing through the oil cooler can be cooled by cooling air flows generated by the fan for cooling the change speed devices.

Therefore, the oil can be cooled without increasing the size and cost of the working vehicle.

DETAILED DESCRIPTION OF PREFERRED EMBODIMENTS

An embodiment in which this invention is applied to a riding type mowing machine which is one example of working vehicles will be described hereinafter.

Figure 1:
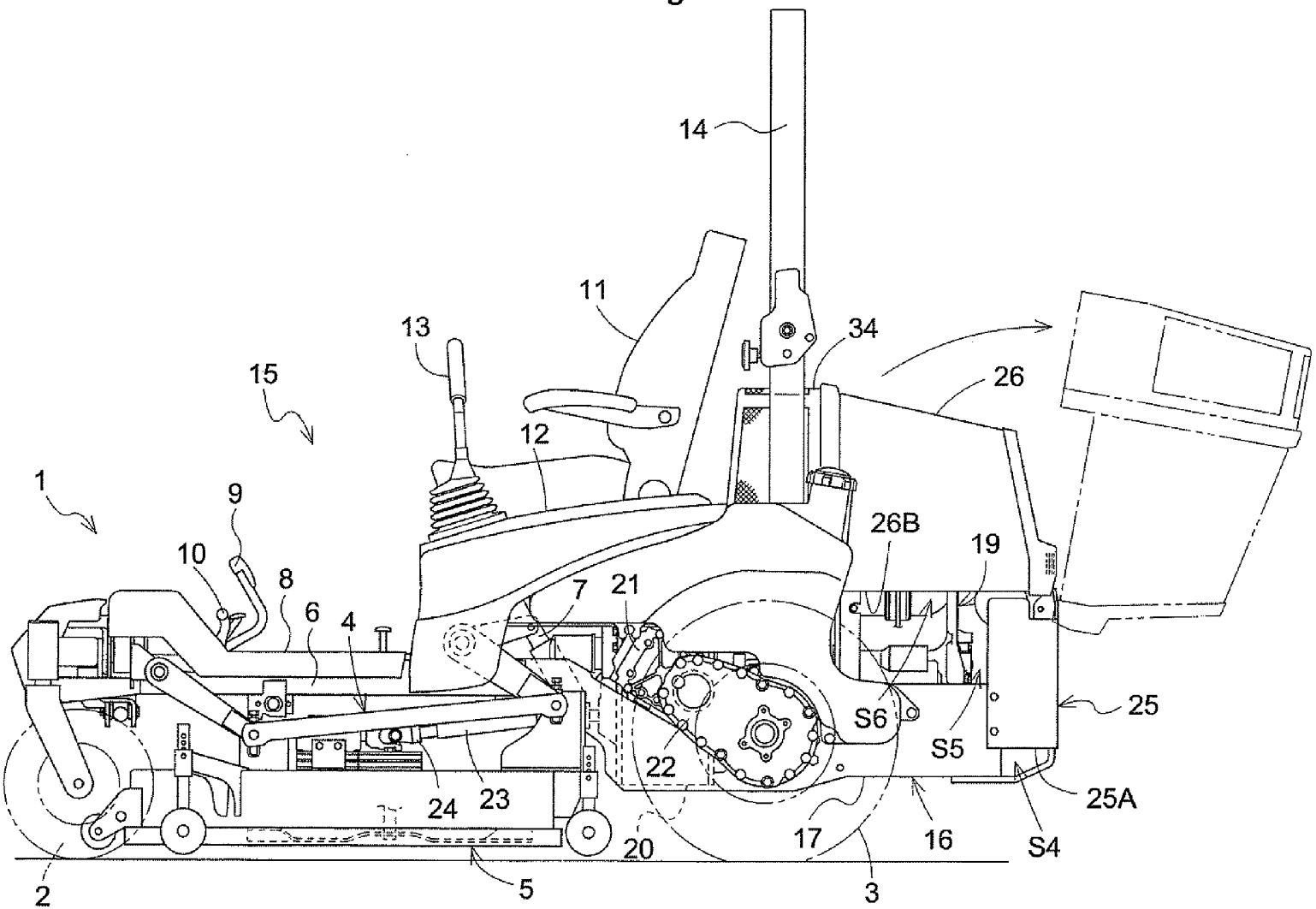
FIG. 1 is a side elevation of a riding type mowing machine.

FIG. 1 shows a side elevation of the riding type mowing machine. As shown in FIG. 1, the riding type mowing machine in this embodiment is constructed the mid-mount type having a mower 5 vertically movably attached through a link mechanism 4 to a vehicle body 1 between a pair of right and left front wheels 2 and a pair of right and left rear wheels 3.

The vehicle body 1 includes a front frame 6 formed of square pipe or the like and disposed in a front part thereof. The front frame 6 supports the link mechanism 4, and has right and left front wheels 2 arranged at right and left ends of a front end thereof to be dirigible about vertical axes. The link mechanism 4 can raise and lower the mower 5 in parallel by operation of a single-acting hydraulic cylinder 7.

The front frame 6 has a boarding step 8 formed of sheet metal and covering substantially the whole of the front frame 6 from above. The boarding step 8 has a rubber mat (not shown) laid over the surface thereof, and has, arranged in a middle front region thereof, a brake pedal 9 biased back to a non-braking position, and a lock pedal 10 for engaging and holding the brake pedal 9 in a braking position against the biasing force. A positionally adjustable driver's seat 11 is disposed rearwardly and upwardly of the boarding step 8. Fenders 12 and shift levers 13 are arranged at right and left sides of the driver's seat 11, respectively. An arch-like protection frame 14 is erected at the back of the driver's seat 11. Thus, this riding type mowing machine has a driving platform 15 formed on a front portion of the vehicle body 1.

As shown in FIGS. 1 through 7, the vehicle body 1 includes a rear frame 16 connected to the rear end of the front frame 6. The rear frame 16 has a pair of right and left side members 17 formed of sheet metal, and support deck 18 supported by rearward parts of the right and left side members 17. The support deck 18 is bent to be substantially L-shaped in side view to have a bottom wall 18A and a front wall 18B, An air-cooled gasoline engine 19 is mounted on the bottom wall 18A to have an output shaft 19A thereof projecting forward of the vehicle body.

A transmission device (an example of change speed devices) 20 is disposed forwardly and downwardly of the engine 19 for slowing down power from the engine 19 and dividing the power into propelling power and working power. The transmission device 20 houses a clutch (not shown) for connecting and disconnecting the working power. Hydrostatic stepless transmissions (which are one example of change speed device, hereinafter abbreviated as HSTs) 21 are arranged at right and left sides of the transmission device 20 for receiving the propelling power from the transmission device 20. A reduction gear 22 is connected to an outer side of each HST 21 for receiving the power after a change speed by the corresponding HST 21. Each reduction gear 22 has a corresponding one of the rear wheels 3 drivably attached thereto. Each HST 21 has a shift rod (not shown) interlocked to a corresponding one of the shift levers 13 to be shiftable in response to forward and rearward rocking of the corresponding shift lever 13.

With this construction, the right and left shift levers 13 are rockable forward and rearward to shift the HST 21 corresponding to each control lever 13. In this way, the right and left rear wheels 3 can be driven at variable speed independently of each other.

That is, this riding type mowing machine has the right and left front wheels 2 dirigible in a follow-up mode, and the right and left rear wheels 3 drivable at variable speed independently of each other. Consequently, the mowing machine can produce, as desired, a stopping state with the right and left rear wheels 3 stopped, a straight moving state with the right and left rear wheels 3 driven at equal speed forward or backward, a large radius turn state with the right and left rear wheels 3 driven at different speeds forward or backward, a pivot turn state with one of the right and left rear wheels 3 stopped and the other driven forward or backward, and a spin turn state with one of the right and left rear wheels 3 driven forward and the other backward, The transmission device 20 has a PTO shaft 20A mounted in a lower front position thereof for taking the working power out for the mower 5. The PTO shaft 20A transmits the working power from the transmission device 20 to the mower 5 through a telescopic transmission shaft 23 and universal joints 24 attached to opposite ends of the transmission shaft 23. That is, the mower 5 receives constant-speed power irrespective of traveling speed and running state.

The rear frame 16 includes a rear cover 25 disposed at the rear end thereof and having right and left side walls 25A and a rear wall 25B. A plurality of exhaust holes 25*a* are formed in the rear wall 25B of the rear cover 25. An upper cover 26 covering an upper portion of the engine 19 from above is connected to the rear cover 25 to be pivotable open and close about an upper end of rear cover 25. The upper cover 26 has a plurality of exhaust holes 26*a* formed in a rear wall 26A thereof. A partition wall 28 is erected on the front wall 18B of the support deck 18 for forming an engine room 27 with the rear frame 16, rear cover 25 and upper cover 26. In the engine room 27, an air cleaner 29 is disposed above the engine 19. A muffler 30 is disposed rearwardly of the engine 19.

Figure 3:
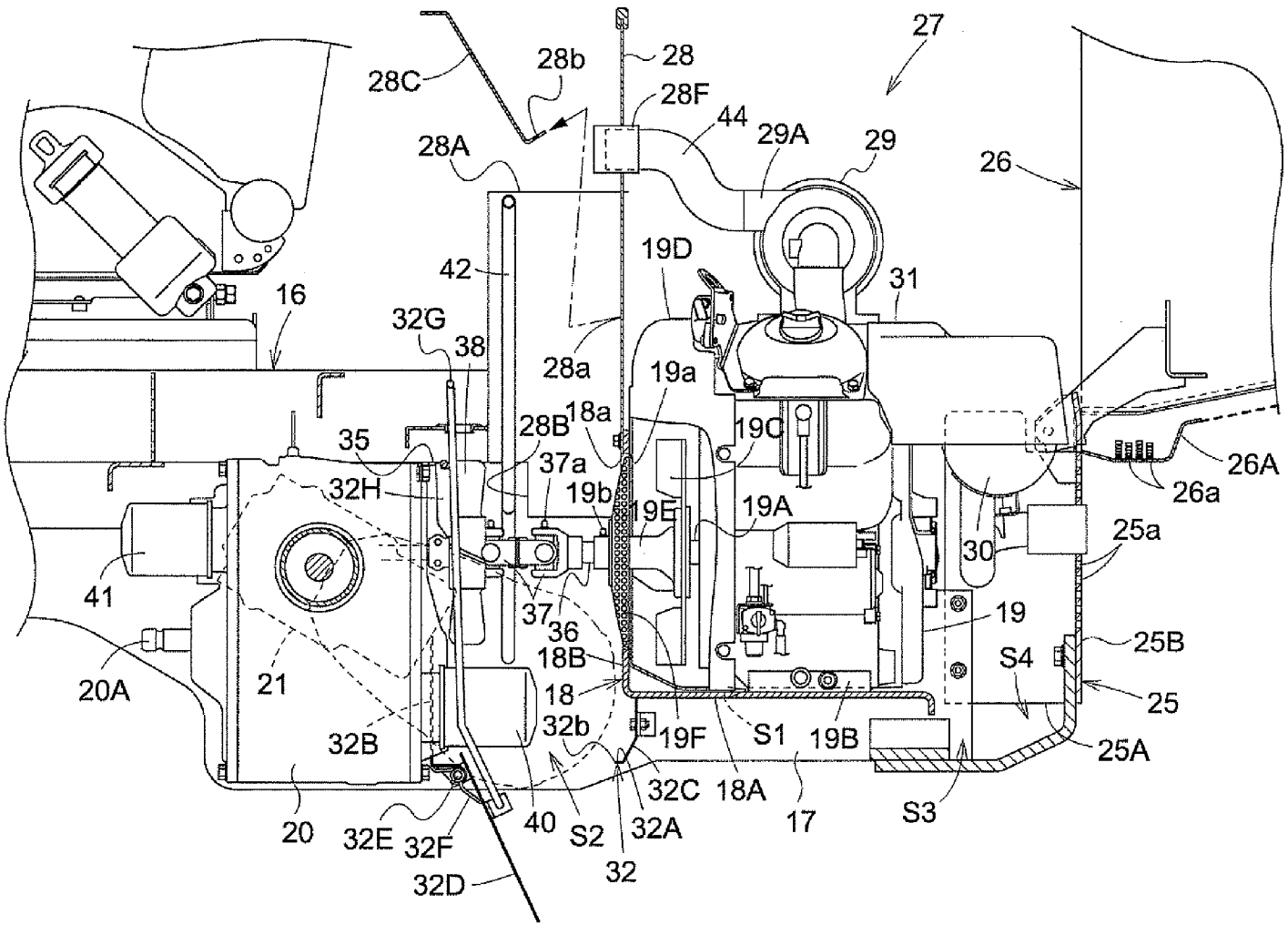
FIG. 3 is a side view in vertical section of the principal portion showing a maintenance state.

Maintenance of the air cleaner 29 such as changing of elements can be carried out easily by opening the upper cover 26 (see FIG. 3). The air cleaner 29 employed is the large-sized cyclone type which is made possible by using a large space formed above the engine 19 inside the engine room 27.

Though not shown, the rear frame 16 includes a holding mechanism holding the rear cover 25 in a closed position.

Figure 2:
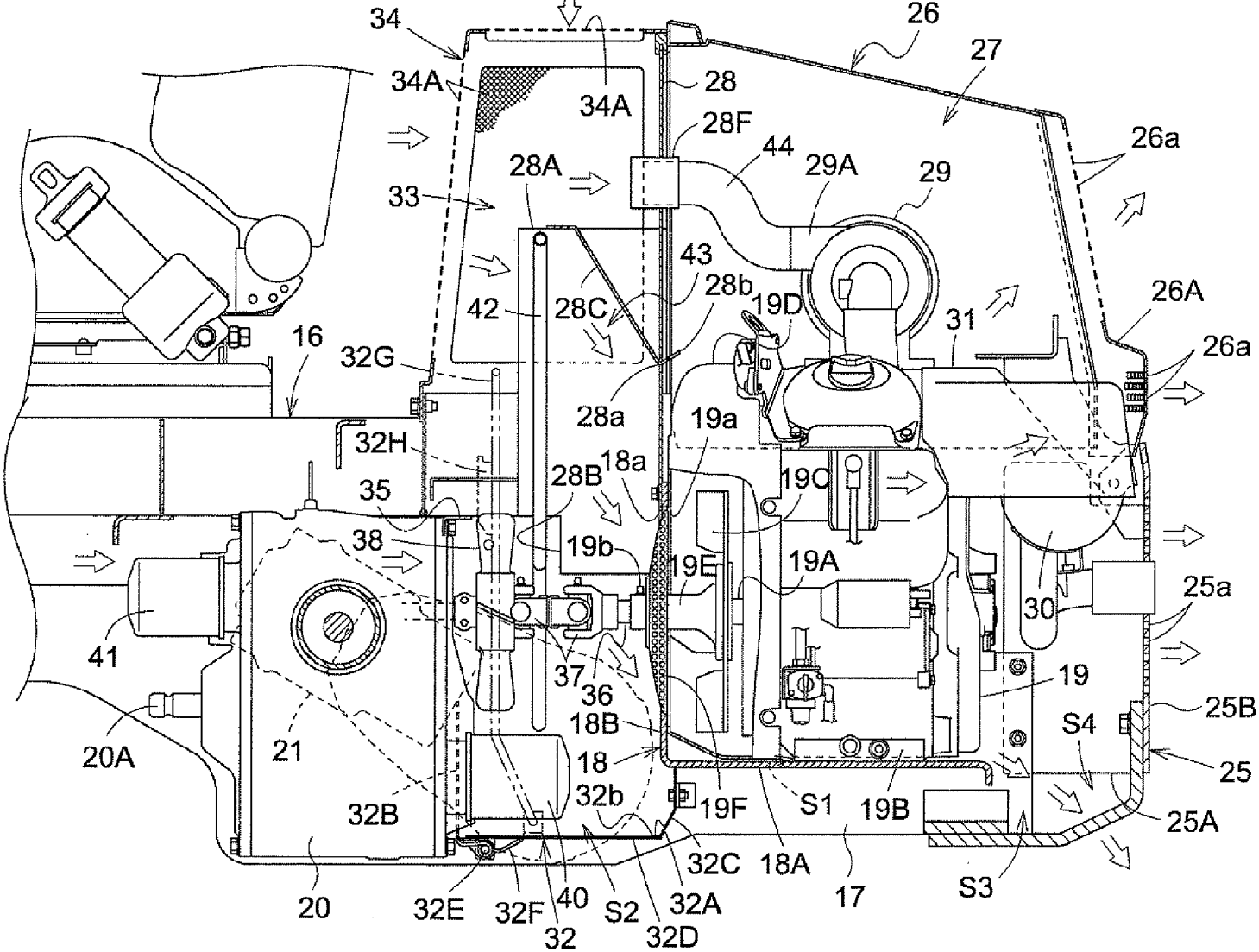
FIG. 2 is a side view in vertical section of a principal portion showing a cooling structure.
Figure 4:
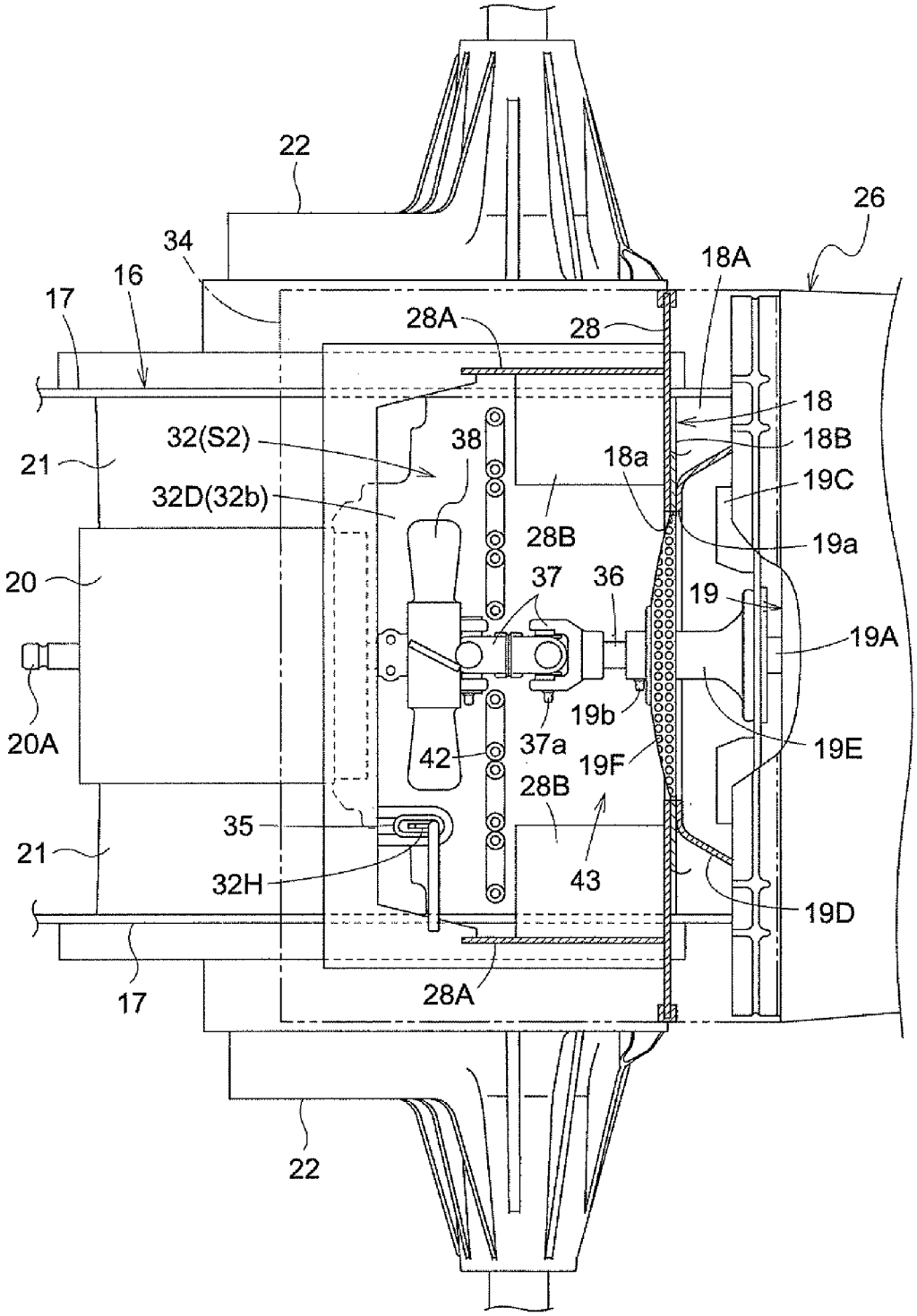
FIG. 4 is a plan view in cross section of the principal portion showing the cooling structure.

As shown in FIGS. 2 through 4, the engine 19 includes a pair of right and left legs 19B for forming a ventilating space S1 between its bottom and the support deck 18. The engine 19 further includes, disposed in front thereof, an engine cooling fan 19C rotatable with the output shaft 19A of engine 19, and an air guide housing 19D covering the cooling fan 19C from front. The cooling fan 19C in rotation draws ambient air into the air guide housing 19D through a circular air intake 18*a* formed in the front wall 18B of the support deck 18 and a circular air intake 19*a* formed in the front of the air guide housing 19D, and causes the ambient drawn in to flow toward the engine 19 as cooling air. The air guide housing 19D guides the cooling air from the cooling fan 19C to areas around the engine 19 to cool the engine 19. Part of the cooling air having passed through the areas around the engine 19 is led to areas around the muffler 30, to cool the muffler 30, by an air guide cover 31 attached to an upper rear end of the engine 19 for covering the muffler 30 from above. The cooling air having cooled the engine 19, muffler 30 and so on is discharged outside through the exhaust holes 25*a* of the rear cover 25 and the exhaust holes 26*a* of the upper cover 26. In this way, despite being the air-cooled type, the engine 19, muffler 30 and so on can be cooled efficiently.

A sleeve shaft 19E is connected to the front end of the cooling fan 19C to be rotatable with the cooling fan 19C about the output shaft 19A. The sleeve shaft 19E supports a circular, porous dust-proof plate 19F for preventing inflow of dust from the air intake 19*a* of the air guide housing 19D to the interior of the housing 19D caused by the sucking action of the cooling fan 19C.

As shown in FIGS. 2 through 5, a dust-proof plate 32 is attached to the bottom of the rear frame 16 and between the right and left side members 17 for covering, from below, a space S2 formed between the transmission device 20 and right and left HSTs 21, and the support deck 18. The dust-proof plate 32 includes a bottom wall 32A extending between the right and left side members 17, a front wall 32B extending from the forward end of the bottom wall 32A upward toward the transmission device 20 and right and left HSTs 21, and a rear wall 32C extending from the rear end of the bottom wall 32A upward toward the support deck 18. The front wall 32B has a recess 32*a* formed therein for receiving the transmission device 20.

This construction can prevent ambient air containing a large quantity of grass clippings and the like from being drawn from under the vehicle body toward the air intake 19*a* of the air guide housing 19D as cooling air by the sucking action of the cooling fan 19C. Instead, ambient air containing a less quantity of grass clippings and the like can be supplied as cooling air from above the vehicle body through between the driver's seat 11 and partition wall 28 toward the air intake 19*a* of the air guide housing 19D.

As a result, the quantity of dust such as grass clippings adhering to or depositing on and around the engine 19 can be reduced drastically, to reduce the time and trouble taken in cleaning.

As shown in FIGS. 1 through 6, a dust removing cover 34 having a dust removing net 34A is formed integral with the front end of the upper cover 26. When the upper cover 26 is in the closed position, the dust removing cover 34 forms an ambient air introducing space 33 with the partition wall 28, and removes dust from the ambient air flowing from above the vehicle body through between the driver's seat 11 and partition wall 28. Thus, cleaner ambient air passing through the ambient air introducing space 33 can be supplied as cooling air from between the driver's seat 11 and partition wall 28 toward the air intake 19*a* of the air guide housing 19D.

Though not shown, the dust removing cover 34 may be formed separately from the upper cover 26, and detachably erected on the rear frame 16.

As shown in FIGS. 2 through 4, an opening 32*b* is formed in the bottom wall 32A of dust-proof plate 32, and a lid 32D is provided for opening and closing the opening 32*b*. The lid 32D is preferably plate shaped. The lid 32D is vertically pivotable between open and closed positions about a pivot shaft 32E extending right and left at the forward end of the bottom wall 32A. The lid 32D is biased upward toward the closed position by a torsion spring 32F mounted on the pivot shaft 32E. The lid 32D has a control rod 32G extending from a left front position of the lid 32D upward toward the ambient air introducing space 33 for enabling the lid 32D to be opened against the biasing force of the torsion spring 32F. The control rod 32G has an engaging piece 32H welded to an upper position thereof for engaging, from below, an engageable element 35 provided in a rear upper left position of the transmission device 20, to hold the lid 32D in the open position with the biasing force of the torsion spring 32F.

With this construction, dust having deposited on an inner surface of the lid 32D can be removed easily through the opening 32*b* of the bottom wall 32A, by opening the upper cover 26 to move the dust removing cover 34 away from the rear frame 16, and operating the control rod 32G to open the lid 32D. Dust having deposited on an inner surface of the dust-proof plate 32 can be removed easily through the opening 32*b* of the bottom wall 32A by holding the lid 32D in the open position.

As shown in FIGS. 2 through 5, power is transmitted from the engine 19 to the transmission device 20 through a transmission shaft 36 relatively slidably splined to the sleeve shaft 19E and a pair of front and rear universal joints 37. The front universal joint 37 has a cooling fan 38 rotatable therewith. The cooling fan 38 in rotation draws ambient air from areas forward of the transmission device 20 and right and left HSTs 21, and causes the ambient air to flow as cooling air around the transmission device 20 and right and left HSTs 21 to cool the transmission device 20 and right and left HSTs 21.

The transmission device 20 has, mounted on a lower rear portion thereof a hydraulic pump 39 for sucking and feeding under pressure oil (or fluid) stored inside the transmission device 20, and a first oil filter 40 of the cartridge type for filtering the oil sucked by the hydraulic pump 39. The oil fed under pressure by the hydraulic pump 39 can be supplied to the hydraulic cylinder 7 for vertically moving the mower, right and left HSTs 21 and clutch by operation of a control valve (not shown) and the like. Oil drained from the hydraulic cylinder 7 for vertically moving the mower, right and left HSTs 21 and clutch is returned to the interior of the transmission device 20. A second oil filter 41 of the cartridge type is mounted on an upper front portion of the transmission device 20 for filtering the oil supplied to the right and left HSTs 21.

Maintenance of the first oil filter 40 such as changing of elements can be carried out easily through the opening 32*b* of the bottom wall 32A by operating the control rod 32G to hold the lid 32D in the open position (see FIG. 3).

Between the partition wall 28 and cooling fan 38 for the change speed devices, an oil cooler 42 is disposed for cooling fluid supplied in circulation to the transmission device 20, hydraulic cylinder 7, right and left HSTs 21 and clutch. The oil cooler 42 is formed to extend to the ambient air introducing space 33 from between the engine cooling fan 19C and cooling fans 38 for the change speed devices, and have lower portions straddling the universal joint 37 so that considerable portions thereof overlap the cooling fan 38 for the change speed devices when seen in the fore and aft direction.

Thus, upper portions of the oil cooler 42 are supplied with engine cooling air flowing through the ambient air introducing space 33 into the air intake 19*a* of the air guide housing 19D by the sucking action of the cooling fan 19C opposed to the oil cooler 42. Lower portions of the oil cooler 42 can be supplied with cooling air for the change speed devices having flowed around the transmission device 20 and right and left HSTs 21 by the sucking action of the cooling fan 38 for the change speed devices.

The partition wall 28 includes a pair of right and left first air guiding plates 28A arranged adjacent right and left ends of the oil cooler 42, a pair of right and left second air guiding plates 28B sloping inward and downward from lower edges of the respective first air guiding plates 28A toward the air intake 18*a* of the support deck 18, and a third air guiding plate 28C extending between the right and left first air guiding plates 28A and sloping rearward and downward from above the oil cooler 42 toward the air intake 18*a* of the support deck 18.

Thus, the right and left first air guiding plate 28 can prevent the heat of the engine room 27 from being drawn in through the air intake 19*a* of the air guide housing 19D by the sucking action of the engine cooling fan 19C. The right and left second air guiding plates 28B and third air guiding plate 28C can form an cooling air guide passage 43 extending from between the driver's seat 11 and partition wall 28 to the air intake 19*a* of the air guide housing 19D, such that the passage 43 is tapered to become narrower from a region adjacent the cooling fan 38 for the change speed devices which is upstream in the flowing direction of cooling air, to a region adjacent the engine cooling fan 19C which is downstream in the flowing direction of cooling air. This increases the speed of the cooling air passing through the air passage 43 of the cooling air, to increase the flow rate per unit time of the cooling air supplied to the engine 19 and oil cooler 42. As a result, the engine 19, and the oil cooler 42 located in the air passage 43, can be cooled efficiently by the cooling air.

The third air guiding plate 28C is detachably attached to the partition wall 28 by engaging a pair of right and left engaging claws 28*b* formed by bending rear ends of the third air guiding plate 28C, into a pair of right and left slits 28*a* formed in the partition wall 28. By removing the third air guiding plate 28C from the partition wall 28, replenishment of grease for the sleeve shaft 19E and universal joint 37 located under the third air guiding plate 28C may be carried out easily through grease nipples 19*b* and 37*a* of the sleeve shaft 19E and universal joint 37. Dust adhering to the dust-proof plate 19F, oil cooler 42 and so on may also be removed easily after removing the third air guiding plate 28C from the partition wall 28 (see FIG. 3).

Figure 5:
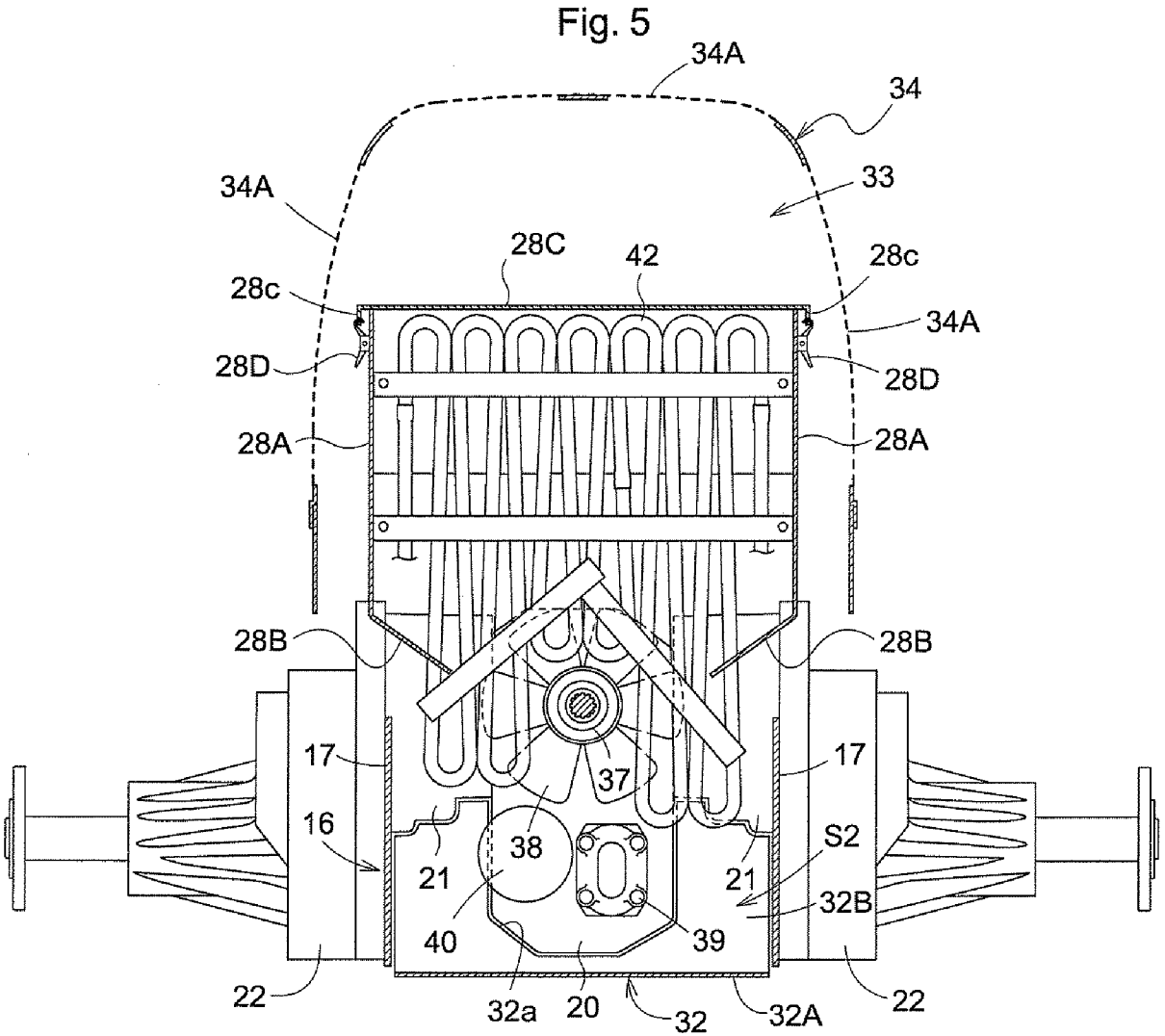
FIG. 5 is a rear view in vertical section of the principal portion showing the cooling structure.

As shown in FIG. 5, the right and left first air guiding plates 28A have buckle type connectors 28D for engaging a pair of right and left engageable elements 28*c* formed on the forward end of the third air guiding plate 28C to connect the forward end of the third air guiding plate 28C to the right and left first air guiding plates 28A. This arrangement can prevent generation of noise due to vibration of the third air guiding plate 28C while the vehicle is traveling, for example.

Though not shown, the third air guiding plate 28C may be attached to the partition wall 28 to be pivotable between an operative position extending from the partition wall 28 to the upper end of the oil cooler 42, and a retracted position standing along the partition wall 28. The partition wall 28 may have an engaging device for engaging the third air guiding plate 28C to retain the third air guiding plate 28C in the retracted position.

Figure 7:
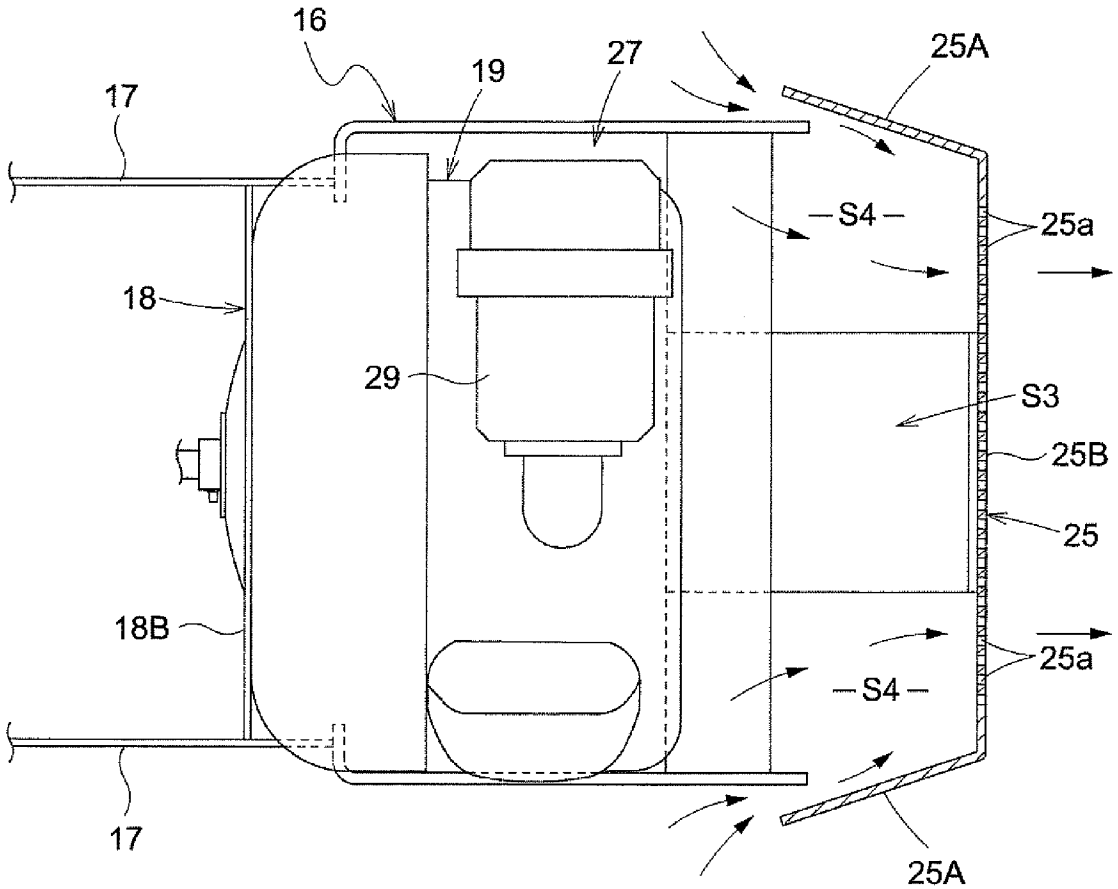
FIG. 7 is a plan view in cross section of a lower rear portion showing flows of cooling air.

As shown in FIGS. 2, 3, and 7, the bottom wall 18A of the support deck 18 has a rear end bent downward. A space S3 is formed between the rear end of the bottom wall 18A and the rear cover 25. The cooling air having passed through the space S1 between the bottom of the engine 19 and the bottom wall 18A of the support deck 18 is guided by the rear end of the bottom wall 18A to flow promptly rearward and downward from the bottom wall 18A, and is subsequently discharged outside the vehicle from spaces S4 formed rearward and downward between the rear frame 16 and rear cover 25. That is, the cooling air for the engine can be made to flow smoothly and promptly through the space S1 between the bottom of engine 19 and the bottom wall 18A of support deck 18, to cool the bottom of engine 19 (lower surface of the crank case) efficiently.

Figure 8:
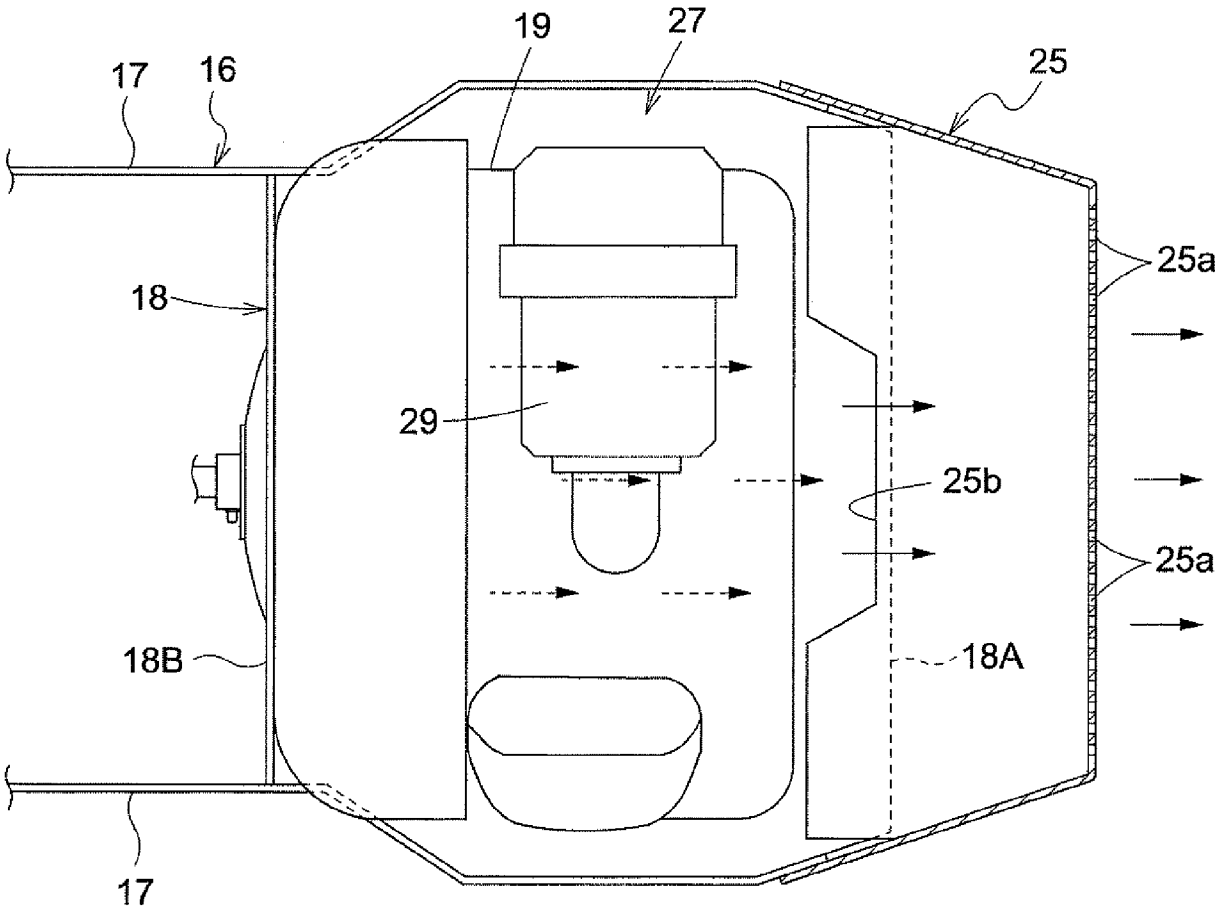
FIG. 8 is a plan view in cross section of a lower rear portion of a modified construction having a rear cover placed on a support deck, showing flows of cooling air.
Figure 9:
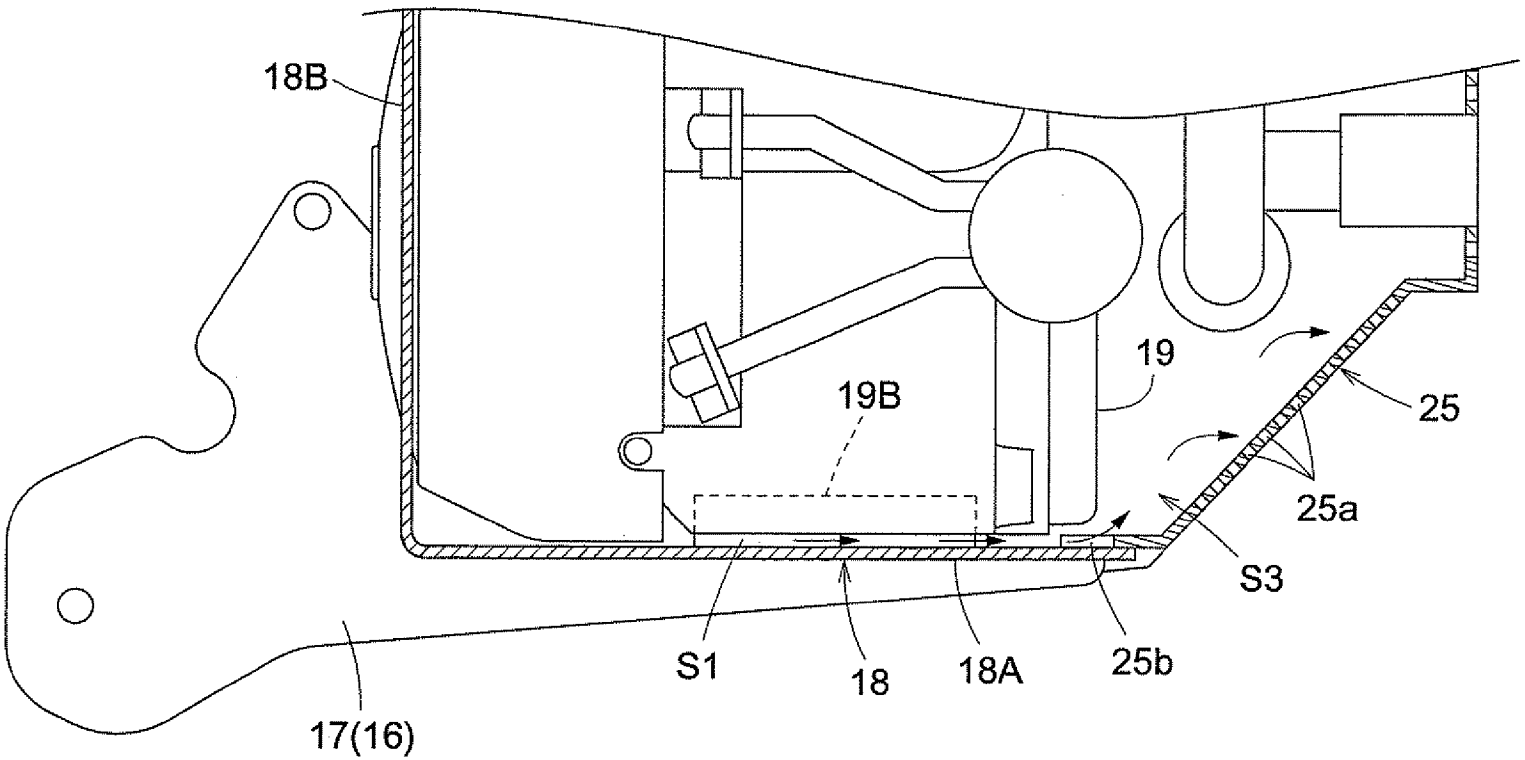
FIG. 9 is a side view in vertical section of a principal portion of the modified construction having the rear cover placed on the support deck, showing flows of cooling air.

As shown in FIGS. 8 and 9, where the rear cover 25 has a forward end placed on a rear end portion of the bottom wall 18A of support deck 18, a recess 25*b* is formed in the forward end of the rear cover 25 for letting out the cooling air having passed through the space S1 between the bottom of engine 19 and the bottom wall 18A of support deck 18. As a result, the cooling air having passed through the space S1 between the bottom of engine 19 and the bottom wall 18A of support deck 18 flows promptly toward the rear cover 25 through the recess 25*b* of the rear cover 25, and is promptly discharged outside the vehicle from the exhaust holes 25*a* of the rear cover 25. That is, the cooling air for the engine can be made to flow smoothly and promptly through the space S1 between the bottom of engine 19 and the bottom wall 18A of support deck 18, to cool the bottom of engine 19 efficiently.

As shown in FIGS. 1 and 7, the rear cover 25 is has right and left side walls 25A inclined to converge with the right and left width progressively narrowing rearward. Thus, as the vehicle travels, ambient air present laterally outward of the engine 19 flows from a space S5 (FIG. 1) formed between each side member 17 of the rear frame 16 and the upper cover 26 toward the rear of engine 19 and the muffler 30 disposed rearwardly of the engine, to be discharged promptly through the exhaust holes 25*a* of the rear cover 25. That is, by action of the rear cover 25, ambient air present laterally outward of the engine 19 can be made to flow smoothly and promptly to the exhaust holes 25*a* of the rear cover 25. These air flows can promote the speed of the engine cooling air flowing from the air intake 19*a* of the air guide housing 19D toward circumferential areas of the engine 19. As a result, the engine 19 and muffler 30 can be cooled with increased efficiency.

Figure 6:
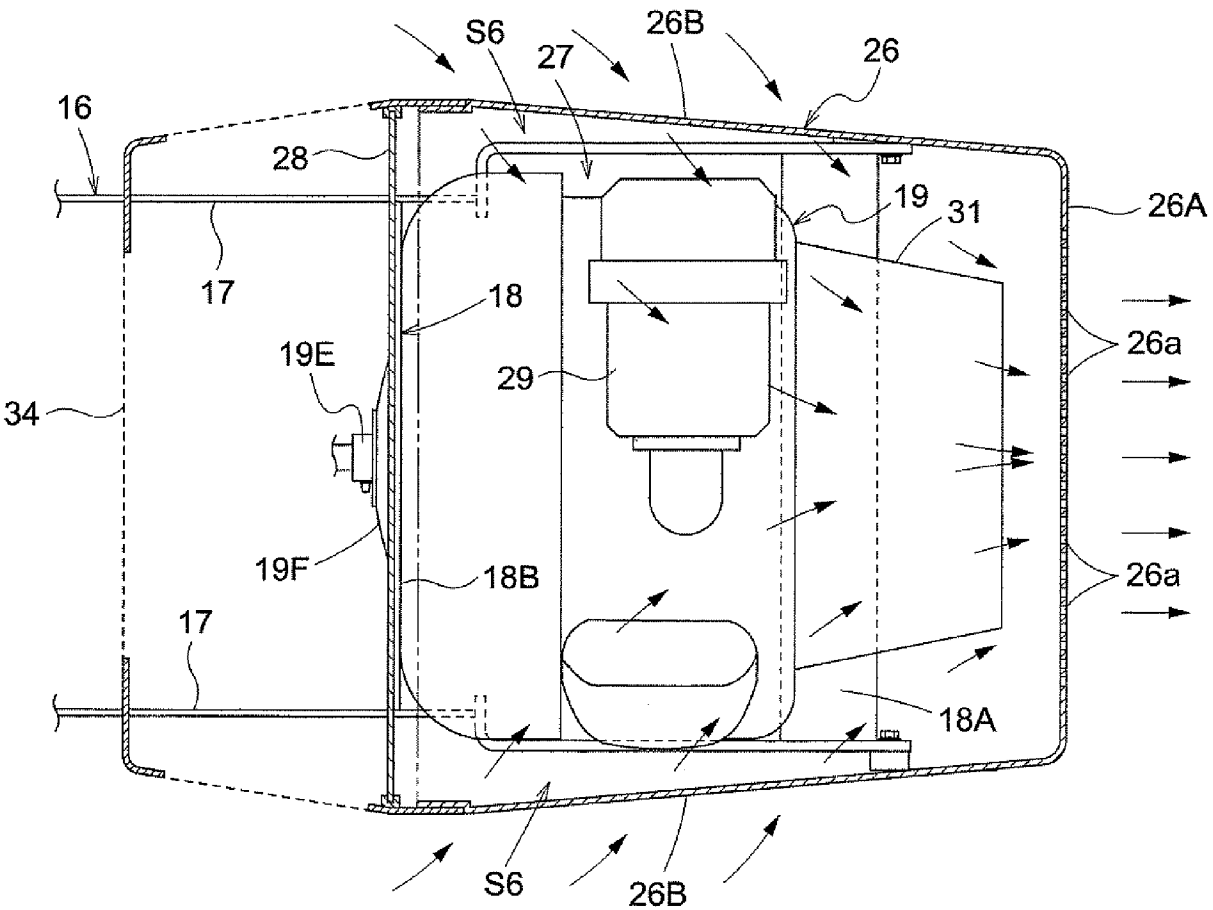
FIG. 6 is a plan view in cross section of an upper rear portion showing flows of cooling air.

As shown in FIGS. 1 and 6, the upper cover 26 is formed to diverge with the right and left width progressively broadening forward in plan view, to form rearwardly converging spaces S6 between right and left lower edges 26B thereof and the rear frame 16. Thus, as the vehicle travels, ambient air present laterally outward of the engine 19 flows from the spaces S6 between the right and left lower edges 26B of the upper cover 26 and the rear frame 16 toward upper portions of the engine room 27, to be discharged promptly through the exhaust holes 26*a* of the upper cover 26. That is, by action of the upper cover 26, ambient air present laterally outward of the engine 19 can be made to flow smoothly and promptly to the exhaust holes 26*a* of the upper cover 26, to prevent the heat remaining in the upper portions of the engine room 27. As a result, it is possible to avoid a situation where the heat stagnates in the upper portions of the engine room 27 housing the air cleaner 29, and engine combustion efficiency lowers owing to a temperature increase of the air supplied to the engine 19.

Figure 10:
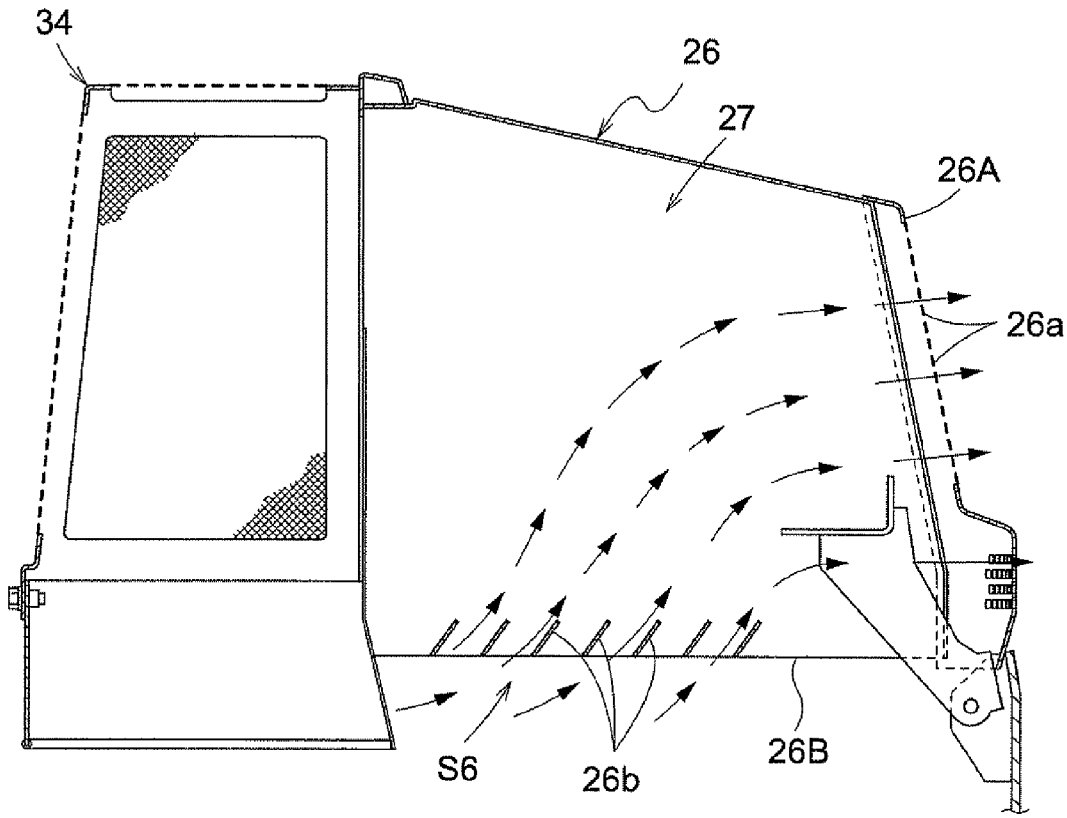
FIG. 10 is a side view in vertical section of a principal portion of a modified construction having guide pieces provided for an upper cover, showing flows of cooling air.
Figure 11:
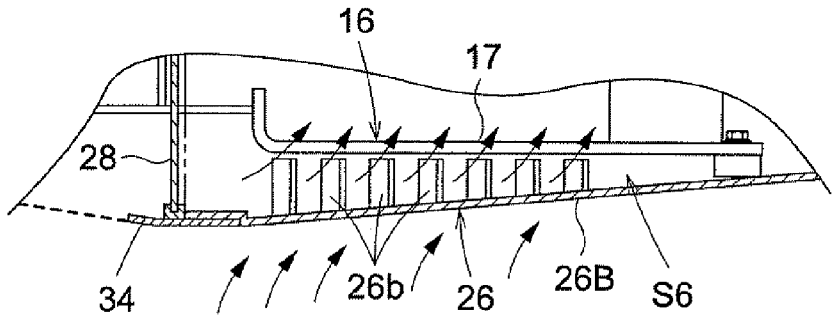
FIG. 11 is a plan view in cross section of the principal portion of the modified construction having the guide pieces provided for the upper cover, showing flows of cooling air.

As shown in FIGS. 10 and 11, a plurality of guide pieces 26*b* may be arranged along the right and left lower edges 26B of the upper cover 26 for guiding the ambient air flowing in from the spaces S6 between the right and left lower edges 26B and the rear frame 16 to flow toward the rear wall 26A of the upper cover 26. Thus, ambient air present laterally outward of the engine 19 is made to flow smoothly and promptly toward the exhaust holes 26*a* of the upper cover 26, thereby to avoid the above-noted lowering of engine combustion efficiency with increased assurance.

Figure 12:
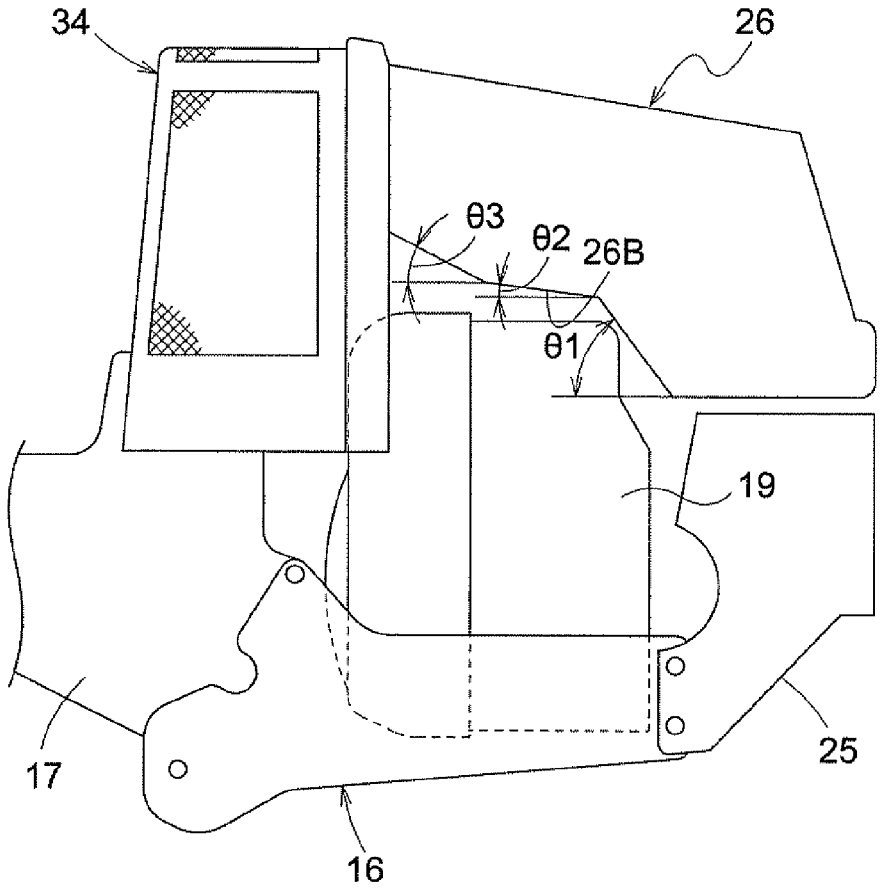
FIG. 12 is a side view of a principal portion of a modified construction having right and left lower edges of an upper cover inclined upward, showing flows of cooling air.

As shown in FIG. 12, the upper cover 26 may have the right and left lower edges 26B inclined upward and forward at predetermined angles θ1-θ3, to facilitate the ambient air present laterally outward of the engine 19 flowing toward the upper portions of the engine room 27, thereby to avoid the above-noted lowering of engine combustion efficiency with increased assurance.

As shown in FIGS. 2 and 3, a communicating tube 28F is disposed above the third air guiding plate 28C of partition wall 28 for communicating the engine room 27 and ambient air introducing space 33. The air cleaner 29 has an air intake hose 44 connected to an inlet pipe 29A thereof and inserted to the communicating tube 28F. Thus, the engine 19 is supplied with fresh ambient air, through the air cleaner 29, immediately after stripped of dust by the dust removing cover 34 above the vehicle body where little grass clippings are scattered, and not influenced by the engine 19 or oil cooler 42. As a result, clogging of the air cleaner 29 can be inhibited effectively. Moreover, it is possible to avoid lowering of engine combustion efficiency due to supplying the engine with heated air, which would occur when air inside the engine room 27 or the ambient air having passed through the oil cooler 42 is supplied to the engine 19.

Though not shown, metal fittings for supporting the air cleaner 29 may be attached to an upper rear surface of the partition wall, so that the air cleaner 29 may be disposed on the upper rear surface of the partition wall 28.

OTHER EMBODIMENTS

[1]The working vehicles to which this invention is applicable include a mid-mount mower having a mower unit 5 disposed between right and left front wheels 2 and right and left rear wheels 3 of a four-wheel drive type vehicle body 1, a front mower, a tractor, a riding type rice planting machine and so on.

[2]The oil cooler 42 may be disposed opposite the cooling fan 38 for the change speed devices across the change speed devices 20 and 21.

[3]The oil cooler 42 may be disposed opposite the cooling fan 38 for the change speed devices without straddling the universal joint 37.

What is claimed is:

1. A cooling structure for a working vehicle with a transmission disposed rearwardly and downwardly of a driver's seat and having a hydrostatic transmission, and an air-cooled engine disposed rearwardly of said transmission, said cooling structure comprising:

a fan for cooling said engine and a fan for cooling said transmission mounted on a rotary shaft operatively connecting said transmission with an output shaft of said air-cooled engine, said fans being configured such that air flows generated by said fans move from adjacent said transmission toward said engine;

an oil cooler for cooling fluid supplied to said hydrostatic transmission, said oil cooler being disposed between said fan for cooling said engine and said fan for cooling said transmission, and disposed to face each of said fans; and an air guiding plate disposed at a position higher than said oil cooler for guiding air to regions of said fans.

2. A cooling structure as defined in claim 1, wherein said engine has an intake port disposed at a position higher than said air guiding plate.

3. A cooling structure as defined in claim 1, further comprising a vertically extending air guiding plate arranged laterally of said oil cooler.

4. A cooling structure as defined in claim 1, further comprising a plate-shaped member disposed between and below said engine and said transmission.

5. A cooling structure as defined in claim 4, wherein the plate-shaped member is configured to pivot about a horizontal shaft between a closed position and an open position which is tilted more downwardly than the closed position.

* * * * *